US009968204B2

(12) United States Patent
Mountz et al.

(10) Patent No.: US 9,968,204 B2
(45) Date of Patent: May 15, 2018

(54) CHILD MOTION APPARATUS

(71) Applicant: Wonderland Switzerland AG, Steinhausen (CH)

(72) Inventors: Jonathan Mountz, Birdsboro, PA (US); Jerry Ingraham, Denver, PA (US); John Huntley, Philadephia, PA (US)

(73) Assignee: Wonderland Switzerland AG, Steinhausen (CH)

( * ) Notice: Subject to any disclaimer, the term of this patent is extended or adjusted under 35 U.S.C. 154(b) by 0 days. days.

(21) Appl. No.: 15/473,580

(22) Filed: Mar. 29, 2017

(65) Prior Publication Data

US 2017/0280891 A1 Oct. 5, 2017

Related U.S. Application Data

(60) Provisional application No. 62/317,817, filed on Apr. 4, 2016.

(51) Int. Cl.

| | |
|---|---|
| ***A47D 9/04*** | (2006.01) |
| ***A47D 13/10*** | (2006.01) |
| *A47C 7/00* | (2006.01) |

(52) U.S. Cl.

CPC ..... *A47D 9/04* (2013.01); *A47D 13/105* (2013.01)

(58) Field of Classification Search

CPC . A47D 9/00; A47D 9/02; A47D 13/00; A47D 13/105; A47C 7/00; A47C 7/725

USPC ..... 472/119, 125; 297/256.1, 256.16, 260.1, 297/260.2, 259.3

See application file for complete search history.

(56) References Cited

U.S. PATENT DOCUMENTS

| | | | | |
|---|---|---|---|---|
| 7,722,118 | B2 * | 5/2010 | Bapst | A47D 9/02 297/256.12 |
| 7,727,078 | B2 * | 6/2010 | Arnold, IV | A47C 7/725 446/227 |
| 7,770,971 | B2 | 8/2010 | Bellows | |
| 8,602,903 | B2 | 12/2013 | Gilbert | |
| 8,834,282 | B2 | 9/2014 | Sclare | |
| 8,876,617 | B2 * | 11/2014 | Robbins | A47D 13/105 472/118 |
| 9,216,359 | B2 | 12/2015 | Gilbert | |

(Continued)

FOREIGN PATENT DOCUMENTS

| | | |
|---|---|---|
| CA | 2544897 C | 8/2013 |
| CN | 101378681 B | 12/2010 |

(Continued)

*Primary Examiner* — Kien Nguyen
(74) *Attorney, Agent, or Firm* — Winston Hsu

(57) ABSTRACT

A child motion apparatus includes an apparatus base, a movable carrier, a seat mount, a motion mechanism, and a seat assembly. The movable carrier is movably disposed on the apparatus base along a sliding direction. The seat mount is rotatably connected to the movable carrier about a rotation axis perpendicular to the sliding direction. The motion mechanism includes a sliding mechanism and a rotating mechanism. The sliding mechanism connects the movable carrier and the apparatus base for sliding the movable carrier relative to the apparatus base along the sliding direction. The rotating mechanism is disposed on the movable carrier and connected to the seat mount for rotating the seat mount about the rotation axis. The seat assembly is detachably connected to the seat mount, so that the seat assembly slides and rotates together with the seat mount.

21 Claims, 15 Drawing Sheets

(56) References Cited

U.S. PATENT DOCUMENTS

| | | | | |
|---|---|---|---|---|
| 2010/0052387 | A1* | 3/2010 | Hopke | A47D 9/02 297/260.2 |
| 2012/0205954 | A1 | 8/2012 | Pollack | |
| 2014/0018179 | A1 | 1/2014 | Mountz | |
| 2015/0245719 | A1* | 9/2015 | Zhong | A47D 13/105 297/260.2 |
| 2015/0289676 | A1 | 10/2015 | Huntsberger | |
| 2015/0289677 | A1 | 10/2015 | Huntsberger | |

FOREIGN PATENT DOCUMENTS

| | | | |
|---|---|---|---|
| CN | 101548836 | B | 9/2011 |
| CN | 102727009 | A | 10/2012 |
| CN | 102894731 | A | 1/2013 |
| CN | 202681300 | U | 1/2013 |
| CN | 202891272 | U | 4/2013 |
| CN | 102894733 | B | 2/2016 |
| EP | 1974634 | A1 | 10/2008 |
| EP | 2 907 414 | A1 | 8/2015 |

* cited by examiner

CHILD MOTION APPARATUS

CROSS REFERENCE TO RELATED APPLICATIONS

This application claims the benefit of U.S. Provisional Application No. 62/317,817 filed on Apr. 4, 2016 is incorporated herein by reference.

BACKGROUND OF THE INVENTION

1. Field of the Invention

The invention relates to a child motion apparatus, and especially relates to a child motion apparatus capable of providing reciprocating motion to child thereon.

2. Description of the Prior Art

Child motion devices have become common household items for families with young children. They offer a safe, comfortable seating area for the child and the option of one or more soothing motions. Some common child motion devices include: pendulum swings, gliders, bouncers and rockers. One of the main drawbacks to swings is that they are generally built with large frames that are complicated to fold or disassemble. Bouncers, rockers and gliders are a more compact solution, but are limited in their motion capability and generally the infant sits near the ground.

SUMMARY OF THE INVENTION

An objective of the invention is to provide a child motion apparatus, which uses a motion mechanism for offering multiple soothing motions and uses a detachable seat assembly for easy transport of the child motion apparatus and additional use of the seat assembly.

A child motion apparatus of an embodiment according to the invention includes an apparatus base, a movable carrier, a seat mount, a motion mechanism, and a seat assembly. The movable carrier includes a platform and is movably disposed on the apparatus base along a sliding direction. The seat mount is rotatably connected to the platform about a rotation axis perpendicular to the sliding direction. The motion mechanism includes a sliding mechanism and a rotating mechanism. The sliding mechanism connects the platform and the apparatus base for sliding the platform relative to the apparatus base along the sliding direction. The rotating mechanism is disposed on the platform and connected to the seat mount for rotating the seat mount about the rotation axis. The seat assembly includes a seat frame and a connection support fixedly connected to the seat frame. The connection support is detachably connected to the seat mount. Thereby, the movable carrier can offer multiple soothing motions through the motion mechanism for the seat assembly. The seat assembly can be detached from the seat frame for easy transport of the child motion apparatus and also can be used independently, e.g. as a bouncer or a rocker.

A child motion apparatus of another embodiment according to the invention includes an apparatus base, a movable carrier, a seat mount, a motion mechanism, and a seat assembly. The movable carrier includes a platform and is movably disposed on the apparatus base along a sliding direction. The motion mechanism includes a sliding mechanism. The sliding mechanism connects the platform and the apparatus base for sliding the platform relative to the apparatus base along the sliding direction. The seat assembly includes a seat frame and a connection support fixedly connected to the seat frame. The connection support is detachably connected to the seat mount. Therein, the seat mount comprises a first engagement structure of a first non-circular structure profile. The connection support comprises a second engagement structure of a second non-circular structure profile. The first non-circular structure profile matches with the second non-circular structure profile. The connection support is detachably connected to the seat mount by engaging the second engagement structure with the first engagement structure in one of at least two orientations of the connection support relative to the seat mount. Similarly, the movable carrier also can offer multiple soothing motions through the motion mechanism for the seat assembly. The seat assembly can be detached from the seat frame for easy transport of the child motion apparatus and also can be used independently, e.g. as a bouncer or a rocker.

A child motion apparatus of another embodiment according to the invention includes an apparatus base, a carrier, a seat mount, a motion mechanism, and a seat assembly. The carrier includes a platform. The seat mount is rotatably connected to the platform about a rotation axis. The motion mechanism includes a rotating mechanism. The rotating mechanism is disposed on the platform and connected to the seat mount for rotating the seat mount about the rotation axis. The seat assembly includes a seat frame and a connection support fixedly connected to the seat frame. The connection support is detachably connected to the seat mount. Therein, the seat mount includes a first engagement structure of a first non-circular structure profile. The connection support includes a second engagement structure of a second non-circular structure profile. The first non-circular structure profile matches with the second non-circular structure profile. The connection support is detachably connected to the seat mount by engaging the second engagement structure with the first engagement structure in one of at least two orientations of the connection support relative to the seat mount. Similarly, the carrier also can offer multiple soothing motions through the motion mechanism for the seat assembly. The seat assembly can be detached from the seat frame for easy transport of the child motion apparatus and also can be used independently, e.g. as a bouncer or a rocker.

These and other objectives of the present invention will no doubt become obvious to those of ordinary skill in the art after reading the following detailed description of the preferred embodiment that is illustrated in the various figures and drawings.

Figure 1:
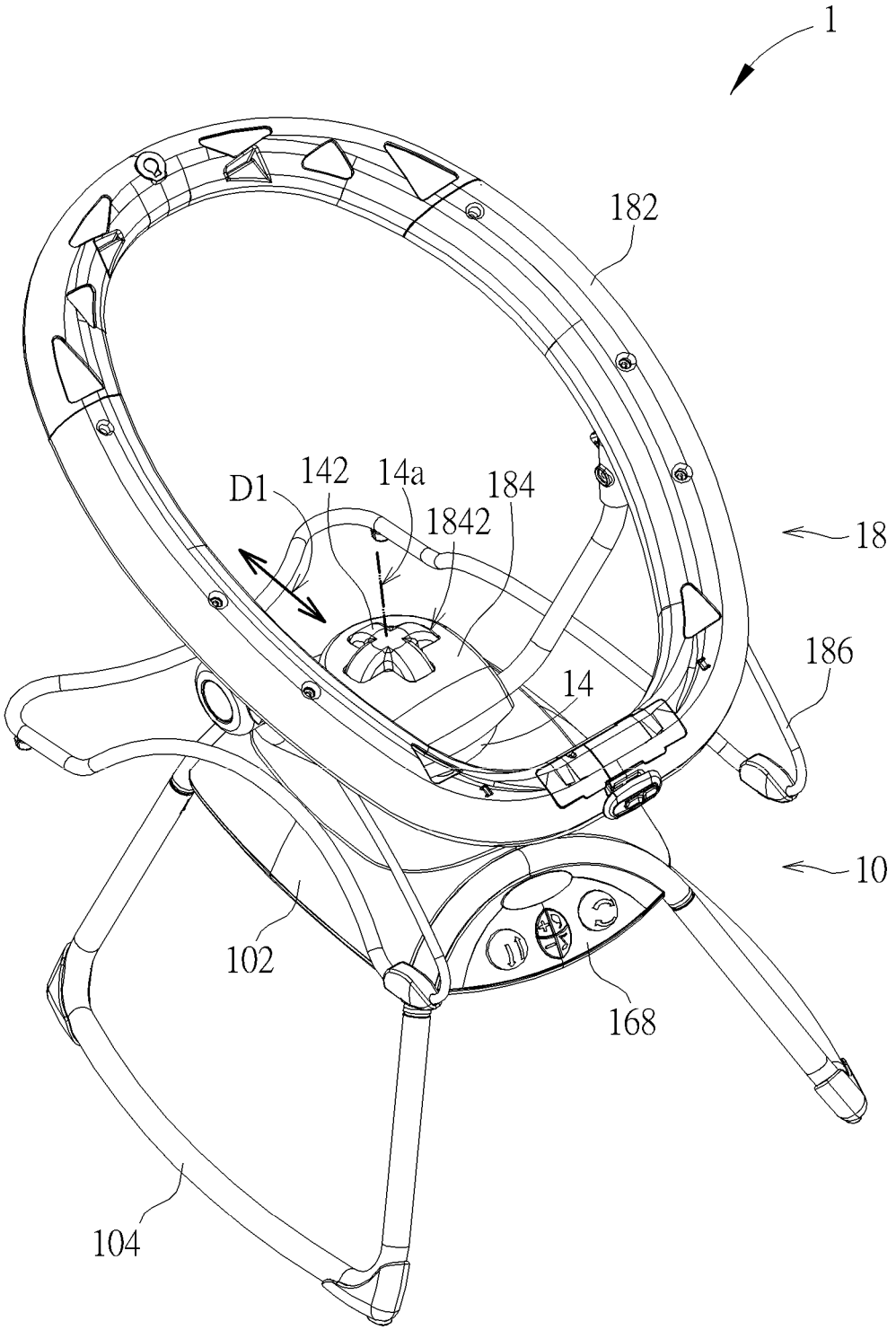
FIG. 1 is a schematic diagram illustrating a child motion apparatus of an embodiment according to the invention.
Figure 7:
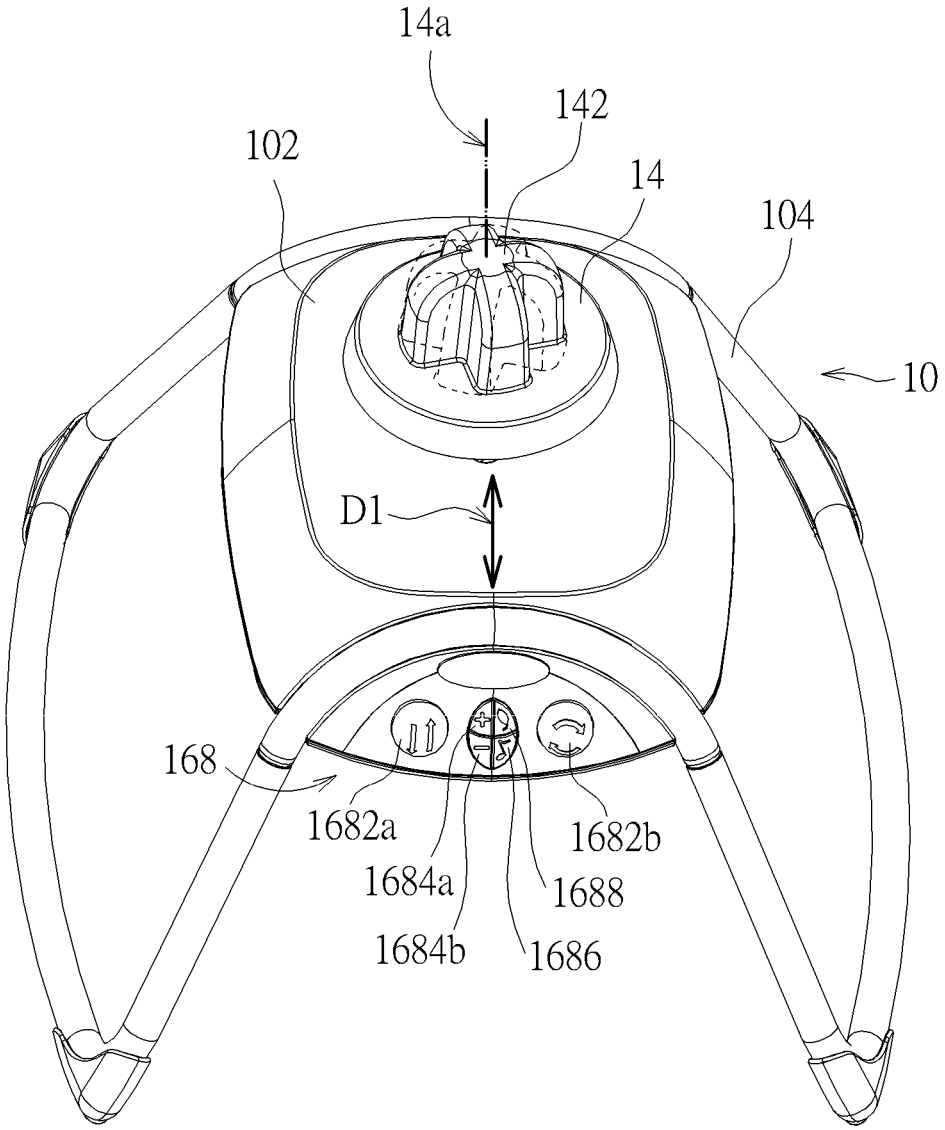

FIG. 7 is a schematic diagram for illustrating a rotational angle range of the seat mount of the child motion apparatus in FIG. 1.

Figure 8:
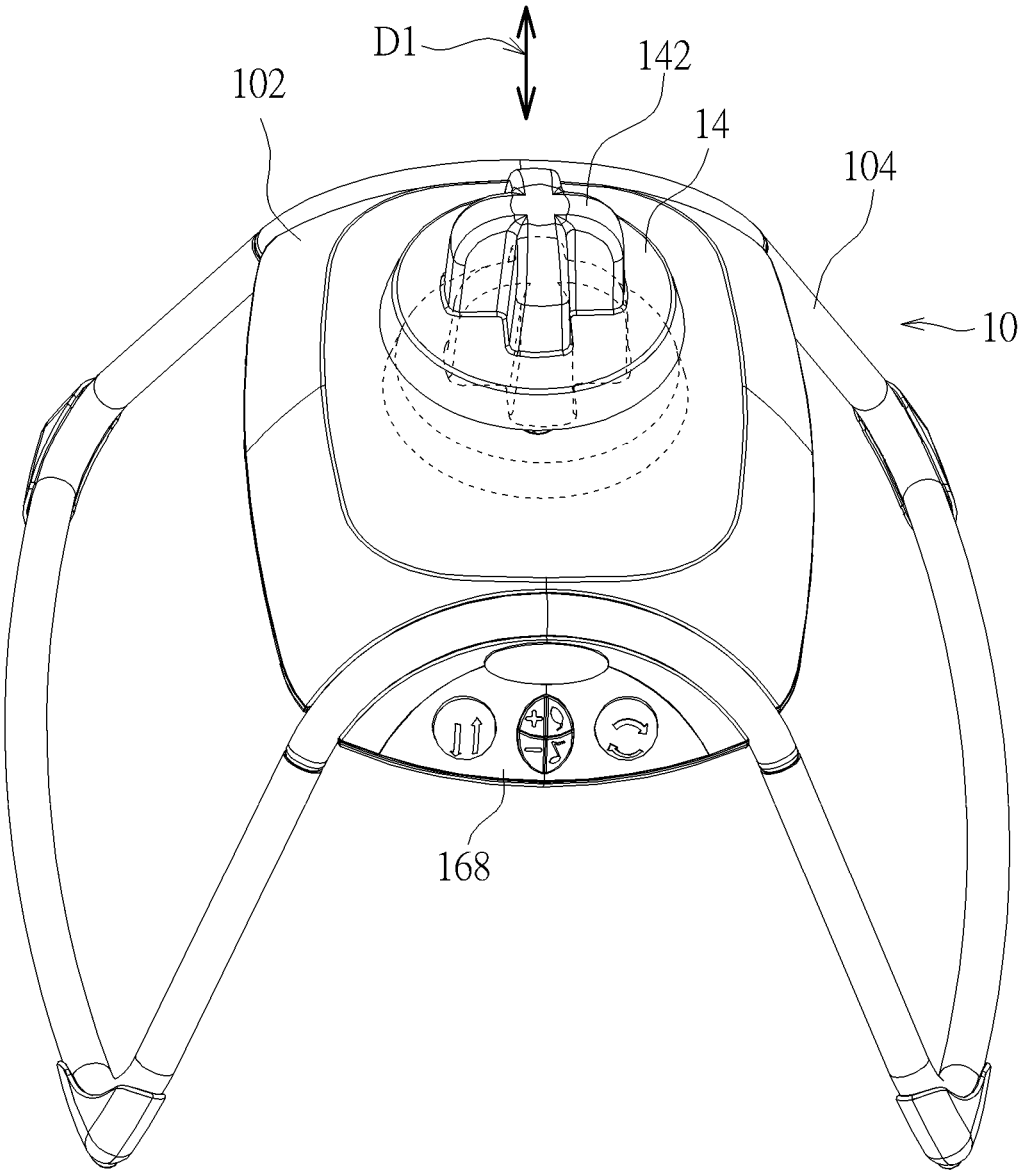

FIG. 8 is a schematic diagram for illustrating a sliding displacement range of the seat mount of the child motion apparatus in FIG. 1.

Figure 9:
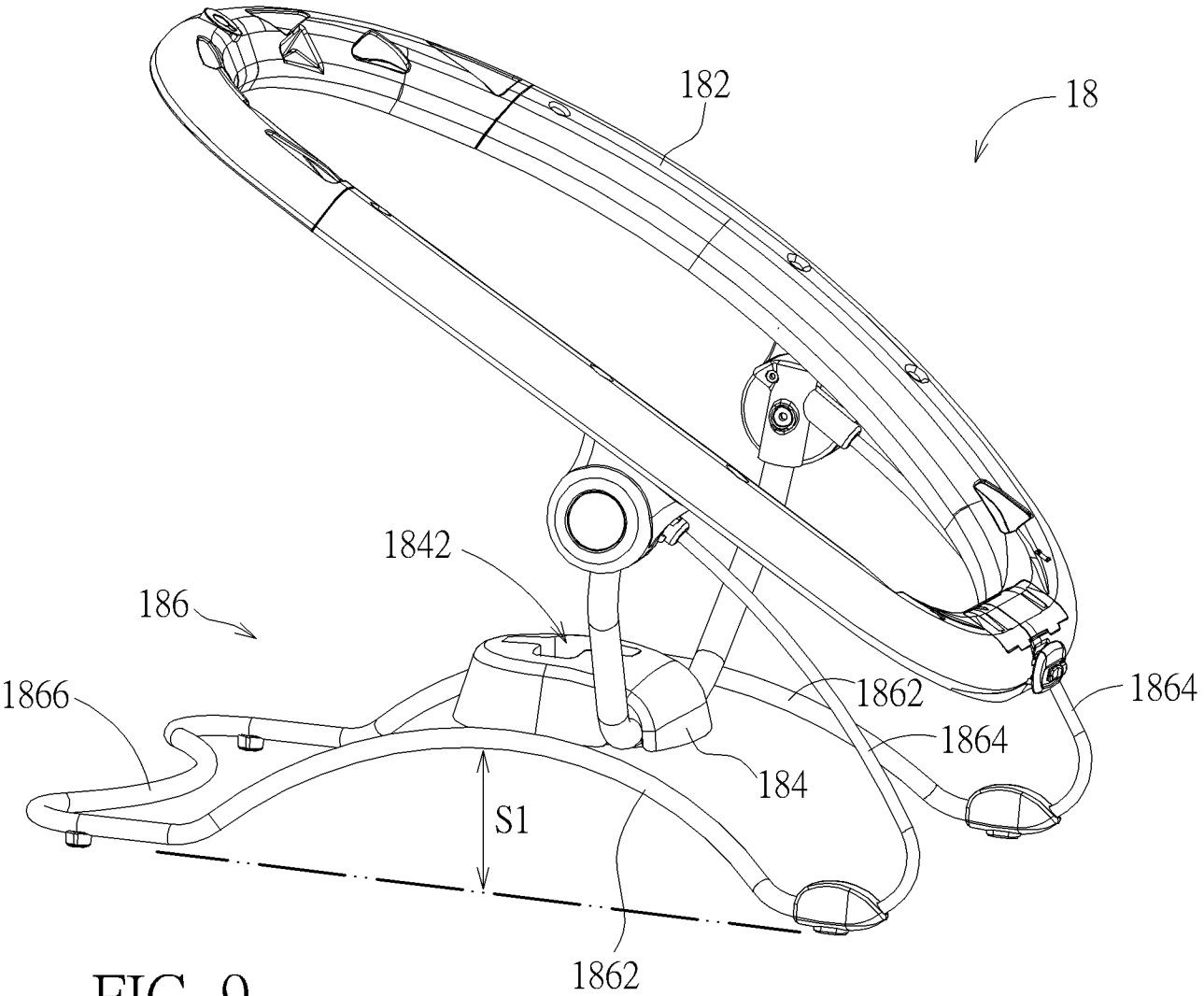

FIG. 9 is a schematic diagram illustrating the seat assembly is used independently.

Figure 10:
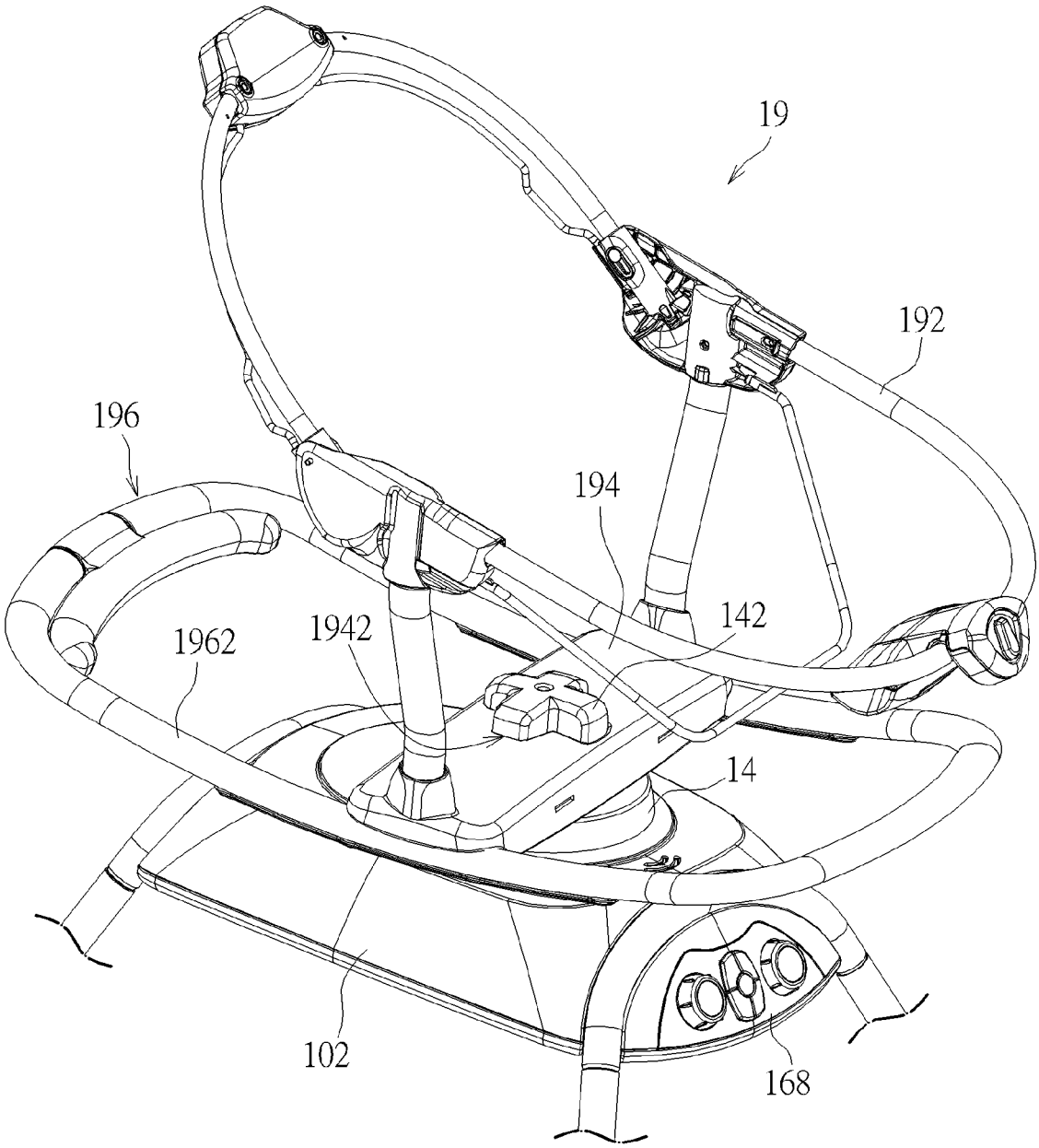

FIG. 10 is a schematic diagram illustrating the child motion apparatus is provided with another seat assembly having a rocking supporting frame.

Figure 11:
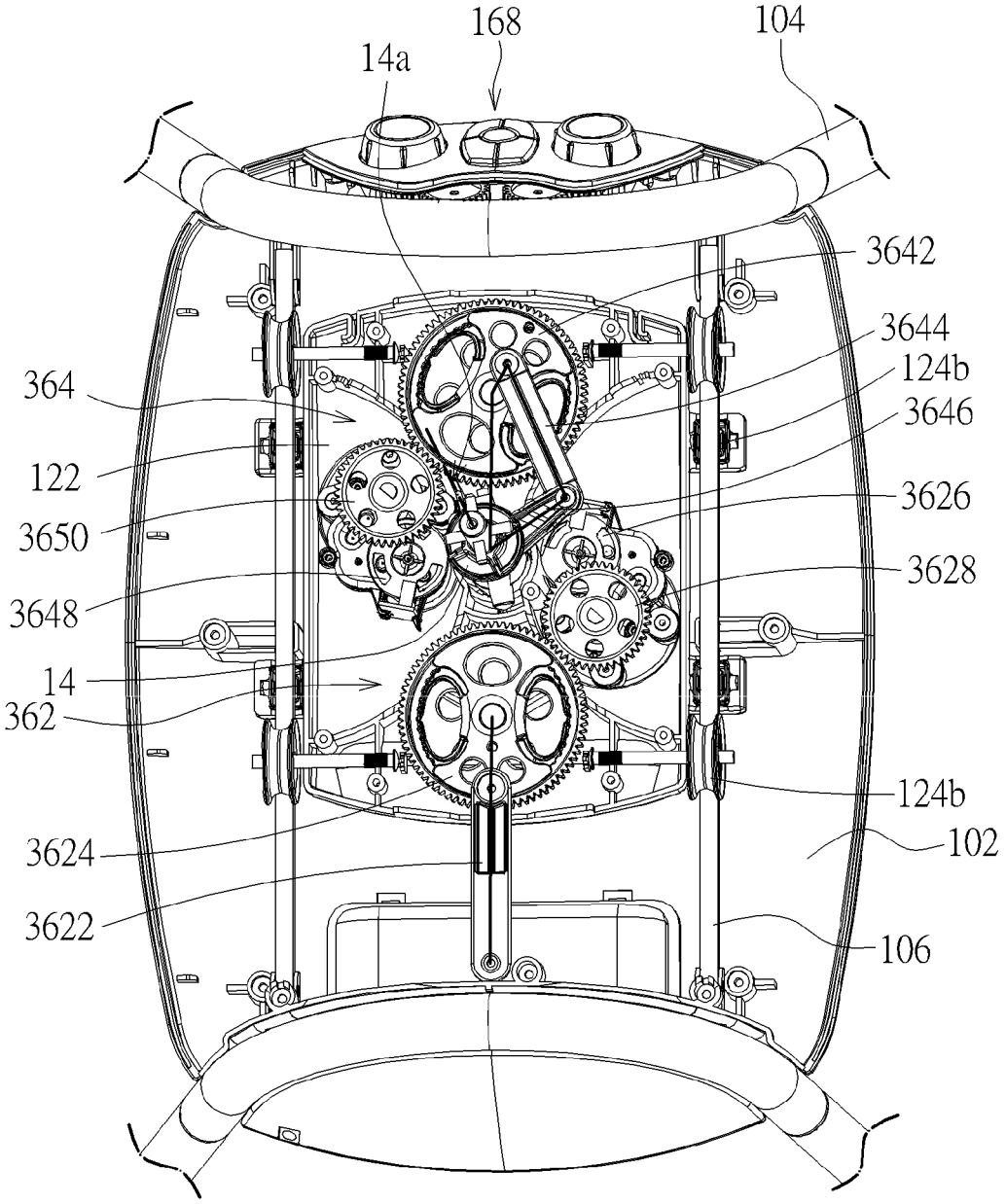

FIG. 11 is a schematic diagram for illustrating a sliding mechanism and a rotating mechanism for the child motion apparatus according to another embodiment in a top view of the apparatus base of the child motion apparatus.

Figure 12:
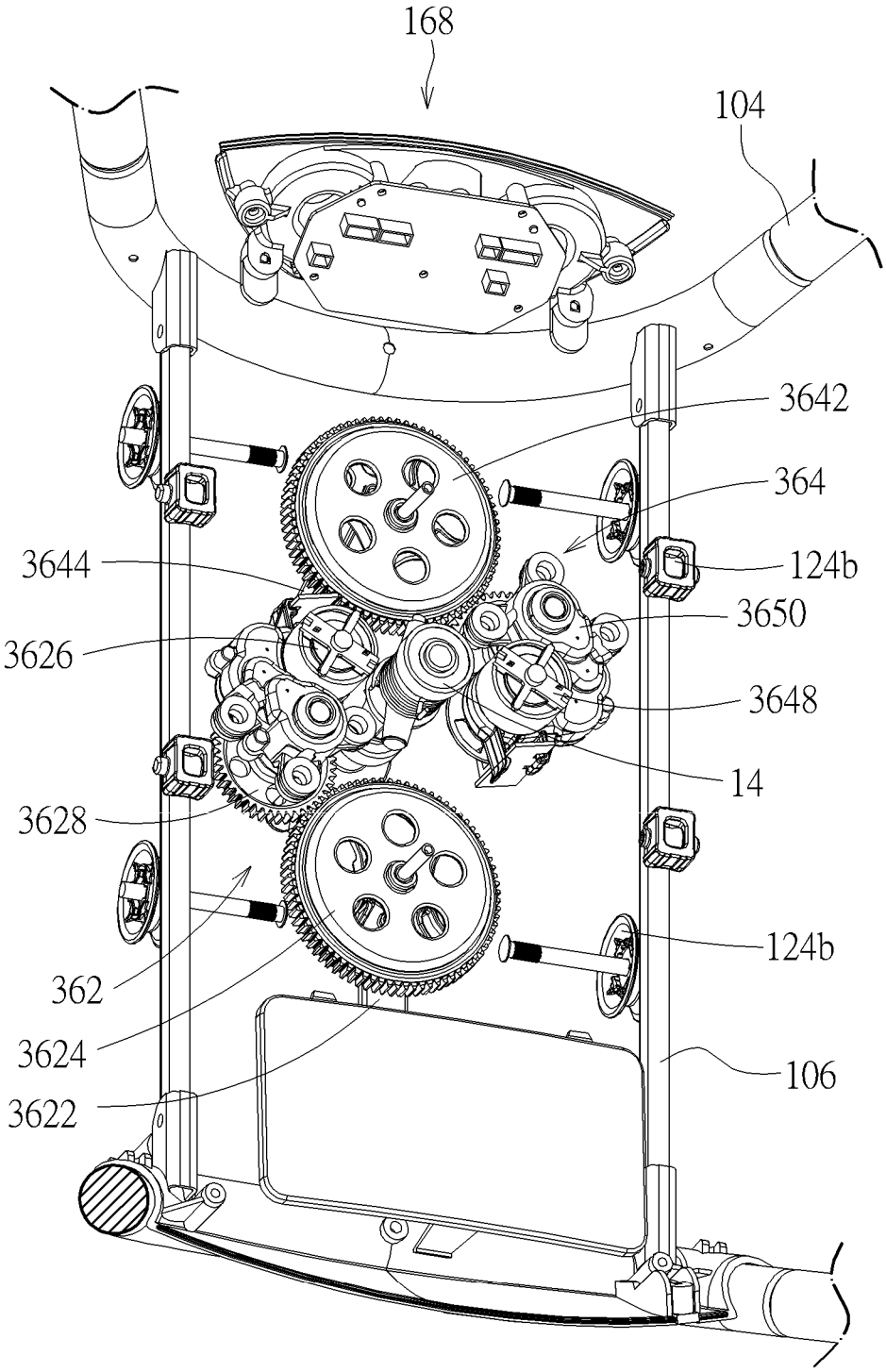

FIG. 12 is another schematic diagram for illustrating the sliding mechanism and the rotating mechanism in FIG. 11 in a bottom view of the apparatus base of the child motion apparatus.

Figure 13:
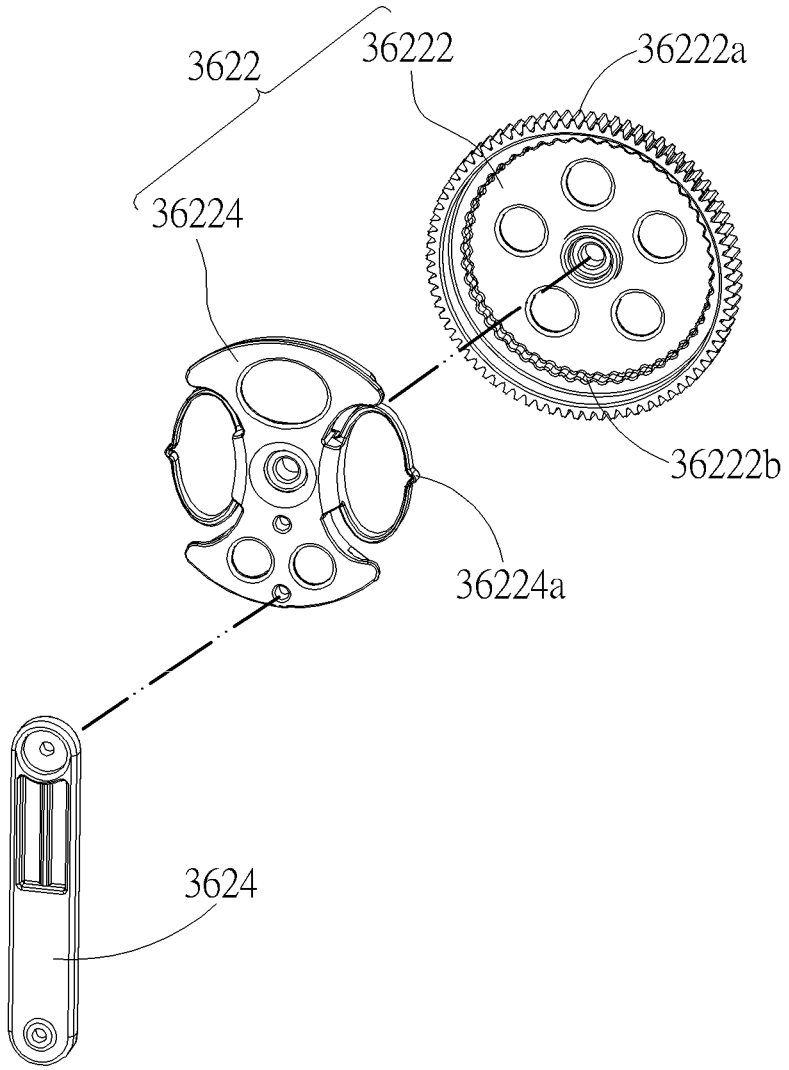

FIG. 13 is an exploded view of a first link part of the sliding mechanism in FIG. 11 in a similar view to FIG. 11.

Figure 14:
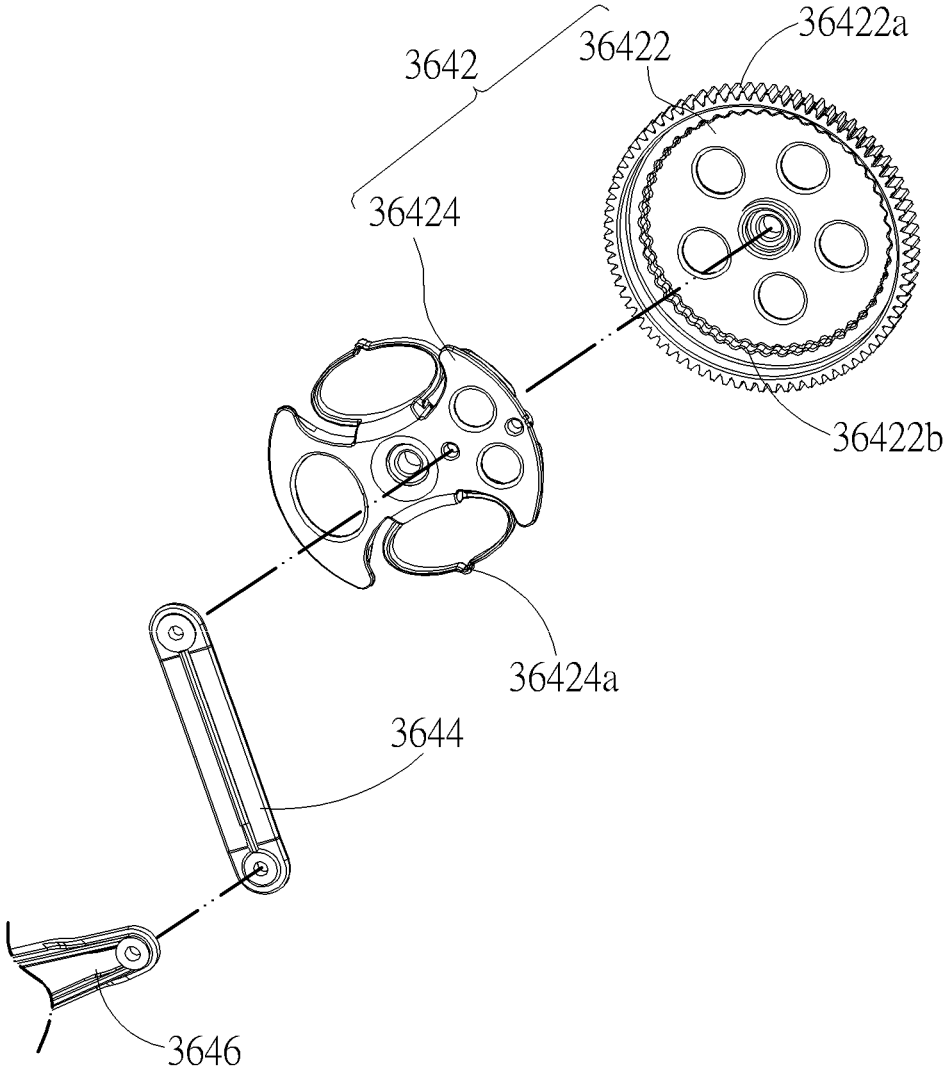

FIG. 14 is an exploded view of a first link part of the rotating mechanism in FIG. 11 in a similar view to FIG. 11.

Figure 15:
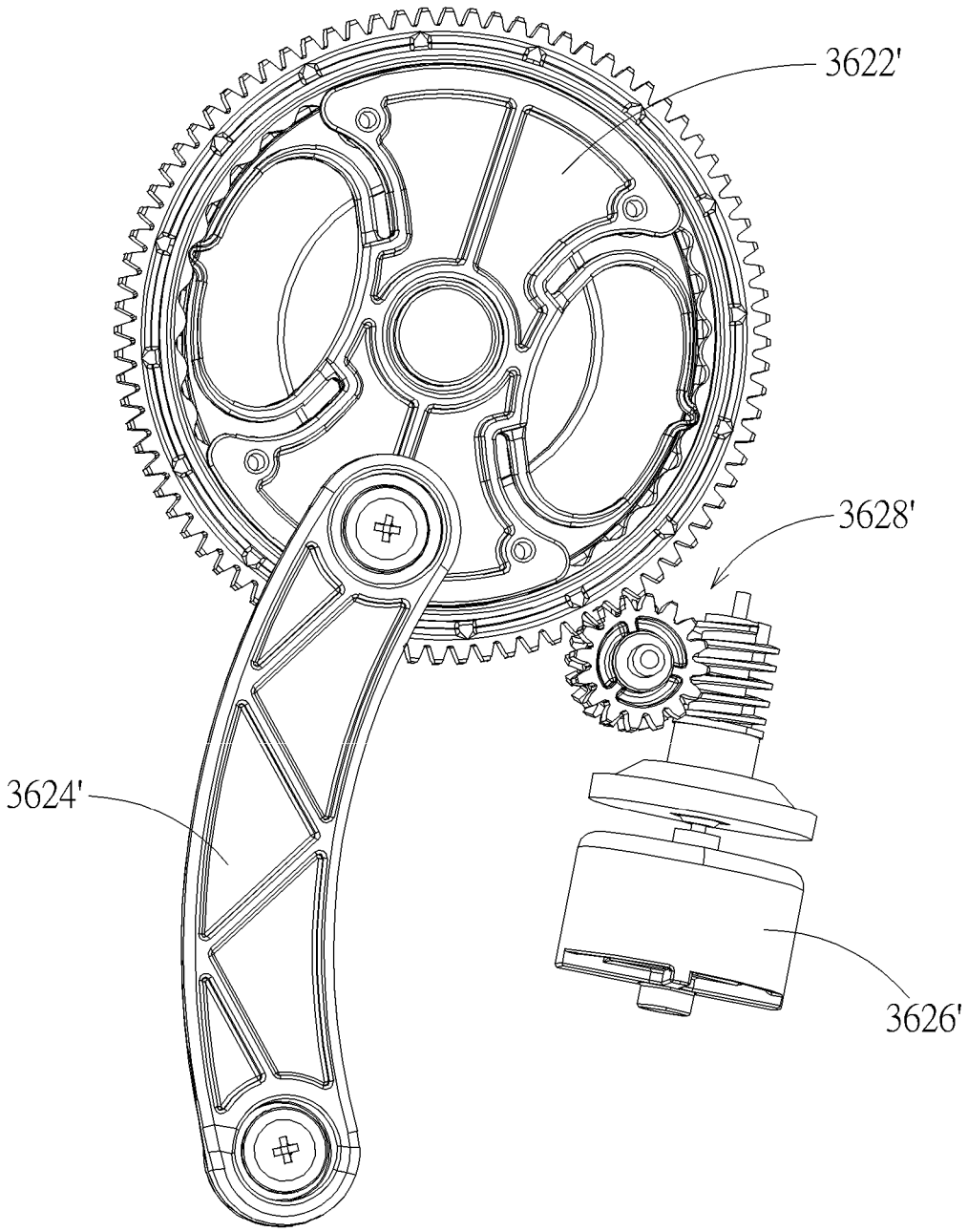

FIG. 15 is a substitute transmission mechanism for the sliding mechanism in FIG. 11.

DETAILED DESCRIPTION

Please refer to FIG. 1 to FIG. 5. A child motion apparatus 1 of an embodiment according to the invention includes an apparatus base 10, a movable carrier 12, a seat mount 14, a motion mechanism 16, and a seat assembly 18. The movable carrier 12 includes a platform 122 and is movably disposed on the apparatus base 10 along a sliding direction D1. The seat mount 14 is rotatably connected to the platform 122 about a rotation axis 14*a* (indicated by a chained line). The rotation axis 14*a* is perpendicular to the sliding direction D1. The motion mechanism 16 includes a sliding mechanism 162 and a rotating mechanism 164. The sliding mechanism 162 is connected to the platform 122 and the apparatus base 10 for sliding the platform 122 relative to the apparatus base 10 along the sliding direction D1. The rotating mechanism 164 is disposed on the platform 122 and connected to the seat mount 14 for rotating the seat mount 14 about the rotation axis 14*a*. The seat assembly 18 includes a seat frame 182 and a connection support 184 fixedly connected to the seat frame 182. The connection support 184 is detachably connected to the seat mount 14. Thereby, by use of the motion mechanism 16, the seat assembly 18 can slide along the sliding direction D1 or/and rotate about rotation axis 14*a*, so as to offer various motions for the child sitting thereon. Nevertheless, our invention is not limited by the motion mechanism 16 including both sliding mechanism 162 and rotating mechanism 164. The motion mechanism can only have either the sliding mechanism or the rotating mechanism.

In the embodiment, the apparatus base 10 includes a base body 102 and a supporting structure 104 connected to the base body 102. The apparatus base 10 is supported through the supporting structure 104, e.g. on the ground. The movable carrier 12, the sliding mechanism 162, and the rotating mechanism 164 are disposed in the base body 102. The seat mount 14 is exposed out of the top of the apparatus base 10 (e.g. a through slot formed on an upper casing of the base body 102 for the seat mount 14 passing through from the interior of the base body 102). The connection support 184 is attached to the seat mount 14 from top of the seat mount 14. In addition, in the embodiment, the seat frame 182 can be used to support an infant carrier or a child car seat thereon. In practice, the seat assembly 18 also can be provided with a carrier of fabric connected to the seat frame 182 so that a child can directly lie thereon.

Figure 3:
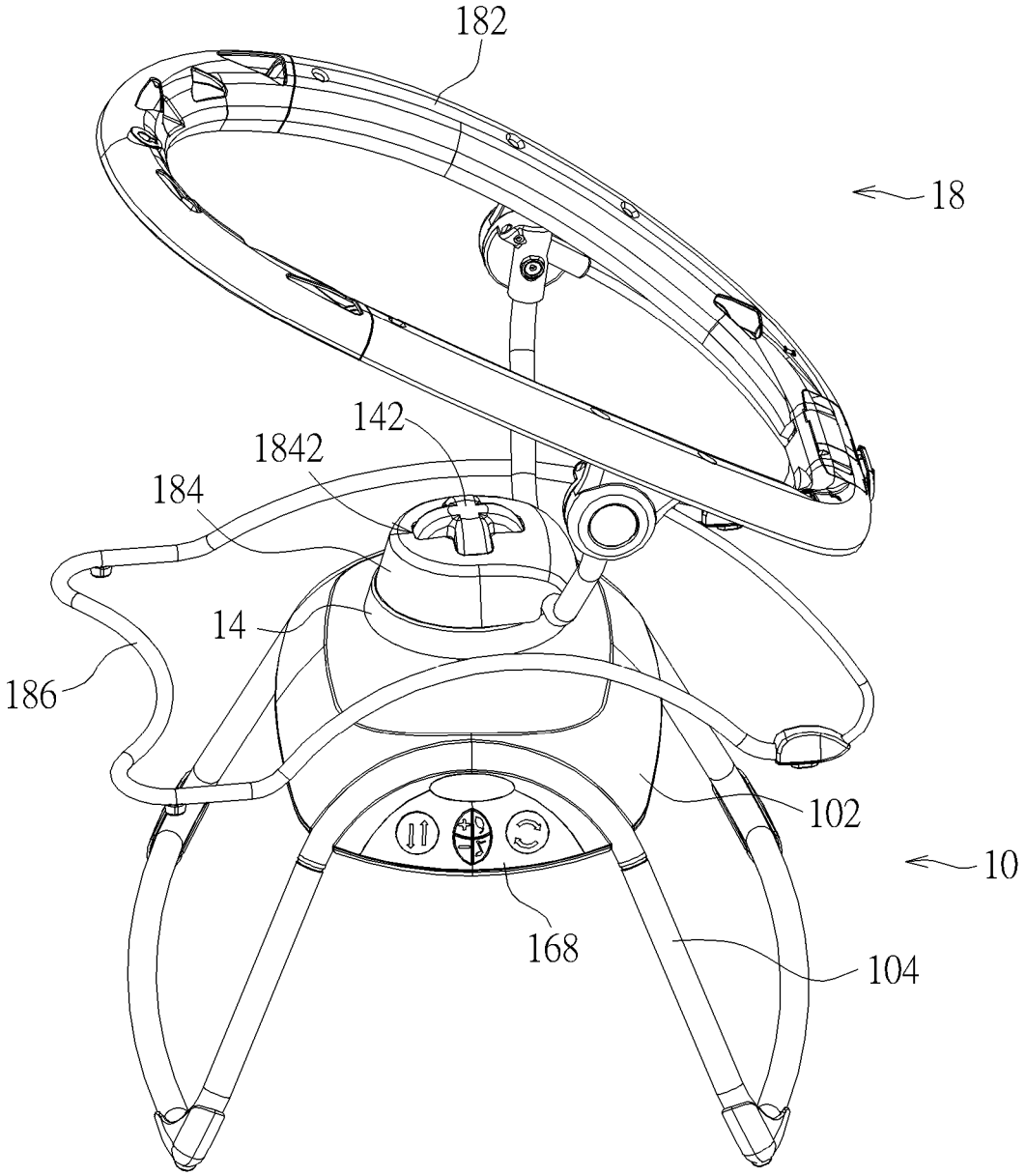
FIG. 3 is a schematic diagram illustrating the child motion apparatus with the seat assembly attached to the seat mount in another orientation.

Furthermore, the seat mount 14 includes a first engagement structure 142 of a first non-circular structure profile relative to the rotation axis 14*a*. The connection support 184 comprises a second engagement structure 1842 of a second non-circular structure profile. The first non-circular structure profile matches with the second non-circular structure profile, but they are not limited to the same profile in practice. The connection support 184 is detachably connected to the seat mount 14 by engaging the second engagement structure 1842 with the first engagement structure 142. In the embodiment, the first non-circular structure profile and the second non-circular structure profile are the same and are a "+" shaped profile, so the connection support 184 can be detachably connected to the seat mount 14 in one of four orientations of the connection support 184 relative to the seat mount 14; that is, the seat assembly 18 can be oriented in four orientations relative to the seat mount 14. For example, the seat mount 14 is oriented forward as shown in FIG. 1 and oriented sideward as shown in FIG. 3; if needed, the seat mount 14 also can be oriented backward. Furthermore, in practice, the quantity of available orientations for the connection support 184 (or the seat assembly 18) attached to the seat mount 14 depends on the engagement structure profiles. For sample, when the first non-circular structure profile and the second non-circular structure profile are octagonal, the connection support 184 has eight orientations to be attached to the seat mount 14. In the embodiment, the first engagement structure 142 is a protrusive structure while the second engagement structure 1842 is a recessed structure (more explicitly a through hole); in practice, the engagement structures 142 and 1842 can be exchanged.

Figure 4:
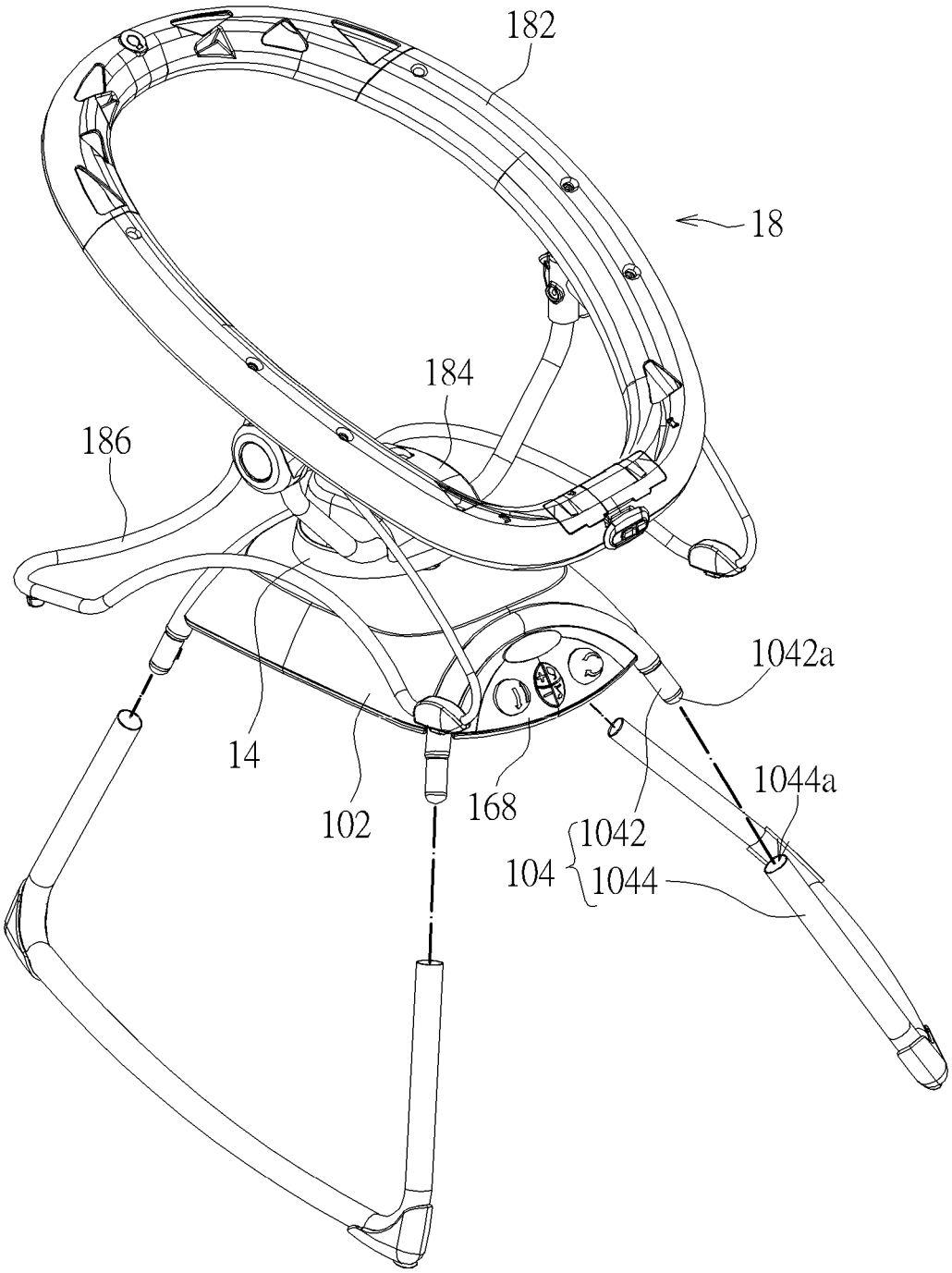
FIG. 4 is a schematic diagram illustrating an apparatus base of the child motion apparatus in FIG. 1 having a sectional supporting structure.
Figure 5:
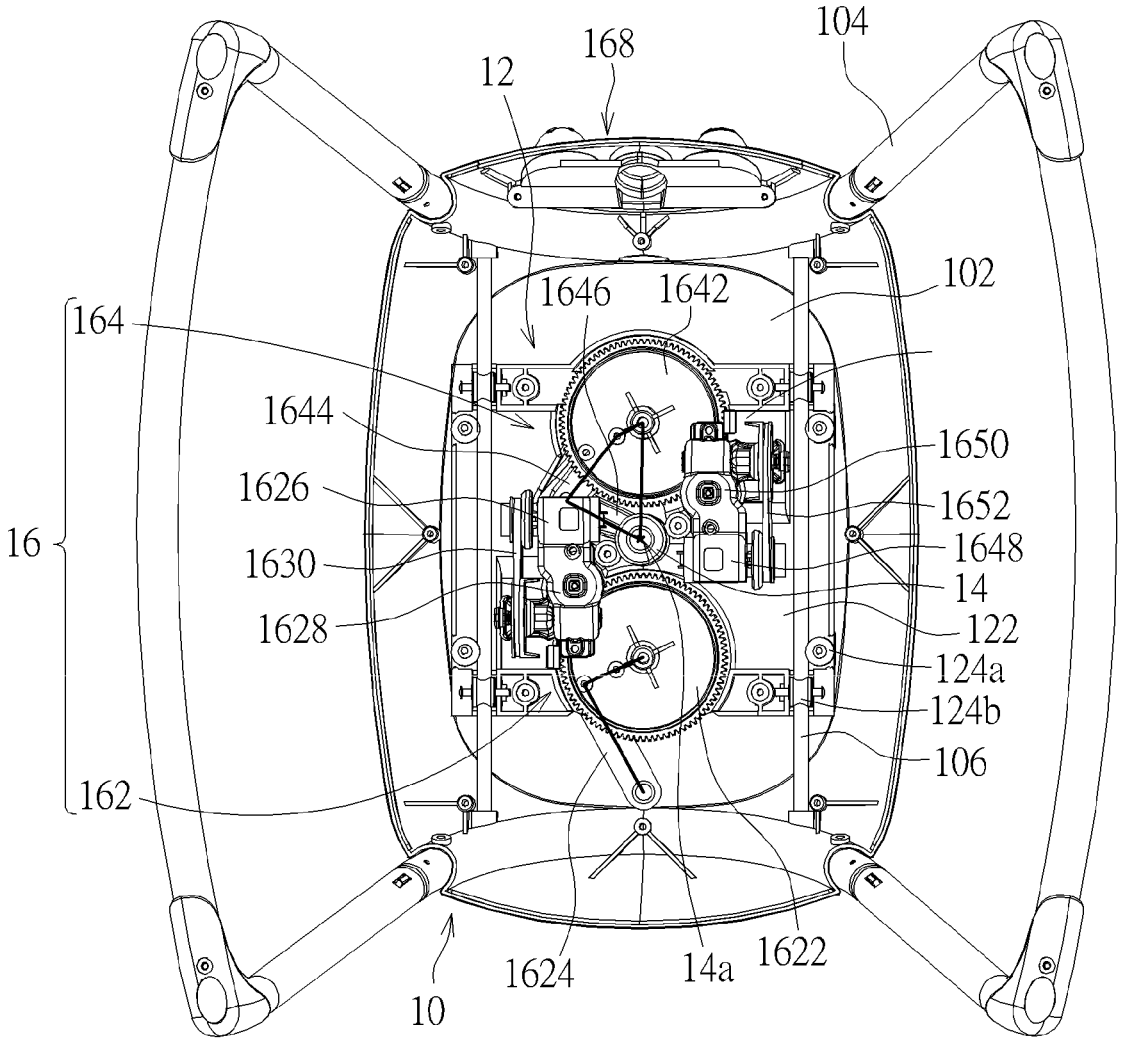
FIG. 5 is a schematic diagram for illustrating a motion mechanism of the child motion apparatus in a bottom view of the apparatus base of the child motion apparatus in FIG. 1.
Figure 6:
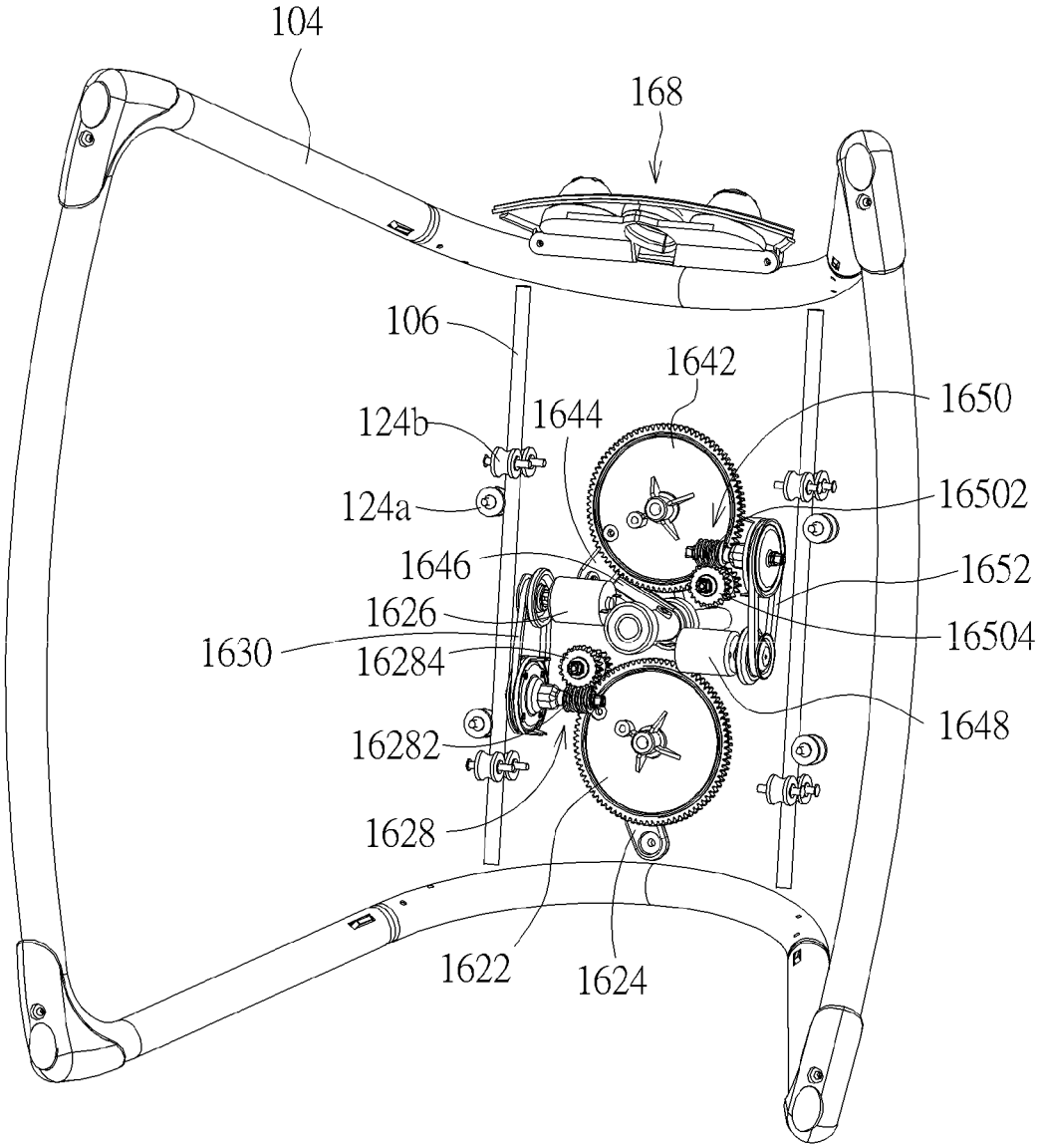
FIG. 6 is another schematic diagram for illustrating the motion mechanism of the child motion apparatus in FIG. 5 in a similar view to FIG. 5; therein, some fixing frames for fixing components of the motion mechanism are not shown.

Please also refer to FIG. 4. In the embodiment, the supporting structure 104 is a sectional structure and includes supporting feet 1042 and expanding leg 1044. The supporting feet 1042 are fixed on the base body 102. The expanding leg 1044 has a hole 1044*a*, of which the inner diameter is slightly larger than the outer diameter of the end portion of the supporting foot 1042, so that the expanding leg 1044 can sleeve on the end portion of the supporting foot 1042. The expanding legs 1044 are detachably connected to the supporting feet 1042 by inserting the supporting feet 1042 into the holes 1044*a*. Thereby, the base body 102 can be supported in different heights. As shown by FIG. 1, the base body 102 is supported in a higher altitude with the expanding legs 1044 attached to the supporting feet 1042. In practice, the base body 102 can be supported in a lower altitude without the expanding legs 1044, which can be understood easily by FIG. 4. In addition, the supporting foot 1042 has a rubber pad 1042*a* fixed at its end. The outer size of the rubber pad 1042*a* is also smaller than the inner diameter of the hole 1044*a*. When the expanding leg 1044 is attached to the supporting foot 1042, the rubber pad 1042*a* is also located in the hole 1044*a*.

Please refer to FIG. 1 to FIG. 3, FIG. 5 and FIG. 6. In the embodiment, the platform 122 (that is not shown in FIG. 6 and is shown with a lower casing thereof removed in FIG. 5 for exposing the motion mechanism 16) is slidable along the sliding direction D1 relative to the apparatus base 10 through two slide rails 106 fixed on the apparatus base 10 (or the base body 102). The movable carrier 12 also includes rollers 124*a* and 124*b* connected to the platform 122. The platform 122 is disposed between the slide rails 106 and the rollers 124*a* and 124*b* engage with the slide rails 106, so that the platform 122 is stably and reliably movable relative to the apparatus base 10. The seat mount 14 is pivotally connected to the platform 122 (e.g. through a shaft). The sliding mechanism 162 includes a first link part 1622 and a second link part 1624, which are pivotally connected to the platform 122 and the apparatus base 10 (or the base body 102) respectively and are pivotally connected with each other. When any one of the first link part 1622, the second link part 1624, and the platform 122 moves, the others will be kinematically driven to move accordingly. Therefore, the first link part 1622, the second link part 1624, the platform 122, and the apparatus base 10 show a four-bar linkage.

In the embodiment, a link length (indicated by a bold line in FIG. 5) of the second link part 1624 is larger than a link length (indicated by a bold line in FIG. 5) of the first link part 1622. The first link part 1622 is a gear wheel. The sliding mechanism 162 includes a first motor 1626 and a gear set 1628. The gear set 1628 is kinematically connected to the first motor 1626 and the gearwheel (or the first link part 1622). Therefore, when the first motor 1626 is powered to drive the gear set 1628, the gear wheel is driven by the gear set 1628 to drive the second link part 1624 to rotate (or sway) so that the platform 122 reciprocates along the sliding direction D1 relative to the apparatus base 10. Furthermore, in the embodiment, the first motor 1626 drives the gear set 1628 through a transmission belt 1630. The gear set 1628 includes a worm screw 16282 and a worm gear 16284 meshing with the worm screw 16282. The worm screw 16282 is kinematically connected to the first motor 1626 through the transmission belt 1630. Therein, the worm screw 16282 is provided with a pulley at one end thereof. The first motor 1626 is provided with a pulley on its output shaft. The transmission belt 1630 is looped over the pulleys for transferring motion therebetween. The worm gear 16284 is kinematically connected to the gear wheel (or the first link part 1622) through a gear meshing. In the embodiment, the worm gear 16284 is fixed connected to another gear meshing with the gear wheel. In addition, in the embodiment, the kinematic engagement of the first motor 1626 with the gear set 1628 is based on the transmission belt 1630, so a slip between the transmission belt 1630 and the pulleys is allowable in practice, which can protect the first motor 1626 from being overheated when it is hard to slide the platform 122, e.g. in a case that the first motor 1626 is overloaded.

Furthermore, in the embodiment, the rotating mechanism 164 includes a first link part 1642, a second link part 1644, and a third link part 1646. The first link part 1642 is pivotally connected to the platform 122. The second link part 1644 is pivotally connected to the first link part 1642. The third link part 1646 is pivotally connected to the second link part 1644 and fixedly connected to the seat mount 14. When any one of the first link part 1642, the second link part 1644, and the third link part 1646 moves, the others will be kinematically driven to move accordingly. Therefore, the first link part 1642, the second link part 1644, the third link part 1646, and the platform 122 also show a four-bar linkage.

In the embodiment, a length sum of a link length (indicated by a bold line in FIG. 5) of the third link part 1646 and a distance (indicated by a bold line in FIG. 5) between the rotation axis 14*a* and a position where the first link part 1642 is pivotally connected to the platform 122 is larger than a length sum of a link length (indicated by a bold line in FIG. 5) of the first link part 1642 and a link length (indicated by a bold line in FIG. 5) of the second link part 1644; a length sum of the link length of the second link part 1644 and the link length of the third link part 1646 is larger than a length sum of the link length of the first link part 1642 and the distance. The first link part 1642 is a gear wheel. The rotating mechanism 164 also includes a second motor 1648 and a gear set 1650. The gear set 1650 is kinematically connected to the second motor 1648 and the gear wheel (or the first link part 1642). Therefore, when the second motor 1648 is powered to drive the gear set 1650, the gear wheel is driven by the gear set 1650 to drive the second link part 1644 to drive the third link part 1646 to rotate (or sway) so that the seat mount 14 rotationally reciprocates about the rotation axis 14*a* relative to the platform 122. Similar to the sliding mechanism 162, the second motor 1648 drives the gear set 1650 through a transmission belt 1652. The gear set 1650 includes a worm screw 16502 and a worm gear 16504 meshing with the worm screw 16502. The worm screw 16502 is kinematically connected to the second motor 1648 through the transmission belt 1652 looped over pulleys of the worm screw 16502 and the second motor 1648. The worm gear 16504 is kinematically connected to the gear wheel (or the first link part 1642) through a gear meshing. For other descriptions about the second motor 1648 and the gear set 1650, please refer to the relevant descriptions of the first motor 1626 and the gear set 1628 of the sliding mechanism 162, which will not be repeated. Similarly, the kinematic engagement of the second motor 1648 with the gear set 1650 through the transmission belt 1652 can protect the second motor 1648 from being overheated when it is hard to slide the platform 122, e.g. in a case that the second motor 1648 is overloaded.

In the embodiment, the motion mechanism 16 comprises a controller and a control panel 168 electrically connected to the controller (e.g. by wires). The electrical connection and other electrical connections that will be described in the following are not shown in the figures; however, they could be easily practiced by a person skilled in this field, e.g. just by wires or cables, and will not be described in addition. The control panel 168 is integrated into the apparatus base 10 in structure. The controller can be but not limited to be disposed on the control panel 168. The first motor 1626 of the sliding mechanism 162 and the second motor 1648 of the rotating mechanism 164 are electrically connected to the controller, so that the controller can control the operation of the first and second motors 1626 and 1648. In practice, the controller can be realized by a circuit board module (e.g. including a circuit board and a processor, a memory, at least one connection interfaces, and other required electronic components which are disposed on the circuit board). When the controller receives an input operation by a user through the control panel 168, the controller, according to the input operation, controls the first motor 1626 of the sliding mechanism 162 to drive the platform 122 to slide relative to the apparatus base 10 along the sliding direction D1 or/and the second motor 1648 of the rotating mechanism 164 to drive the seat mount 14 to rotate about the rotation axis 14*a* (i.e. the seat assembly 18 rotates together with the seat mount 14).

In the embodiment, the control panel 168 includes two motion knobs 1682*a* and 1682*b*, which are electrically connected to the controller and through which the controller receives the input operation. The motion knobs 1682*a* and 1682*b* respectively and independently control the rotating speed of the first motor 1626 of the sliding mechanism 162 and the rotating speed of the second motor 1648 of the rotating mechanism 164. In other words, the motion knob 1682*a* allows the user to adjust the speed of sliding reciprocation of the seat mount 14 (or the seat assembly 18); the motion knob 1682*b* allows the user to adjust the speed of rotating reciprocation of the seat mount 14 (or the seat assembly 18). Therefore the child motion apparatus can create different modes of motion through manipulating the motion knobs 1682*a* and 1682*b* on the control panel 168.

Furthermore, the child motion apparatus 1 includes a speaker (not shown in the figures) disposed on the apparatus base 10 (or in the base body 102) and electrically connected to the controller. The control panel 168 includes two volume buttons 1684*a* and 1684*b*, a music button 1686, and an imitative noise button 1688, which are electrically connected to the controller and through which the controller receives the input operation. The music button 1686 allows the user to turn on or turn off the speaker for music. For example, the controller controls the speaker to play music (e.g. pre-stored in the memory of the controller) when the music button 1686 is pressed; the controller controls the speaker to stop playing music when the music button 1686 is presses again. The imitative noise button 1688 allows the user to turn on or turn off the speaker for an imitative noise, e.g. like the noise a baby can hear in a uterus, which can soothe a child sitting on the seat assembly 18. For example, the controller controls the speaker to play the imitative noise (e.g. pre-stored in the memory of the controller) when the imitative noise button 1688 is pressed, and to stop playing when the imitative noise button 1688 is pressed again. The volume buttons 1684*a* and 1684*b* allow the user to adjust an output volume of the speaker by pressing one of the two volume buttons. For example, the controller to adjust the output volume of the speaker up or down when the volume button 1684*a* or the volume button 1684*b* is pressed respectively.

In the embodiment, in practice, the child motion apparatus 1 can offer a sway motion through the seat mount 14 within a maximum rotational angle, e.g. 40 degrees (e.g. rotationally reciprocating about the rotation axis 14*a* from 20 degrees left to 20 degrees right relative to the sliding direction D1), as shown by FIG. 7, and also offer a sliding motion through the seat mount 14 within a maximum sliding displacement, e.g. 3 inches (e.g. linearly reciprocating along the sliding direction D1 within 3 inches), as shown by FIG. 8.

Figure 2:
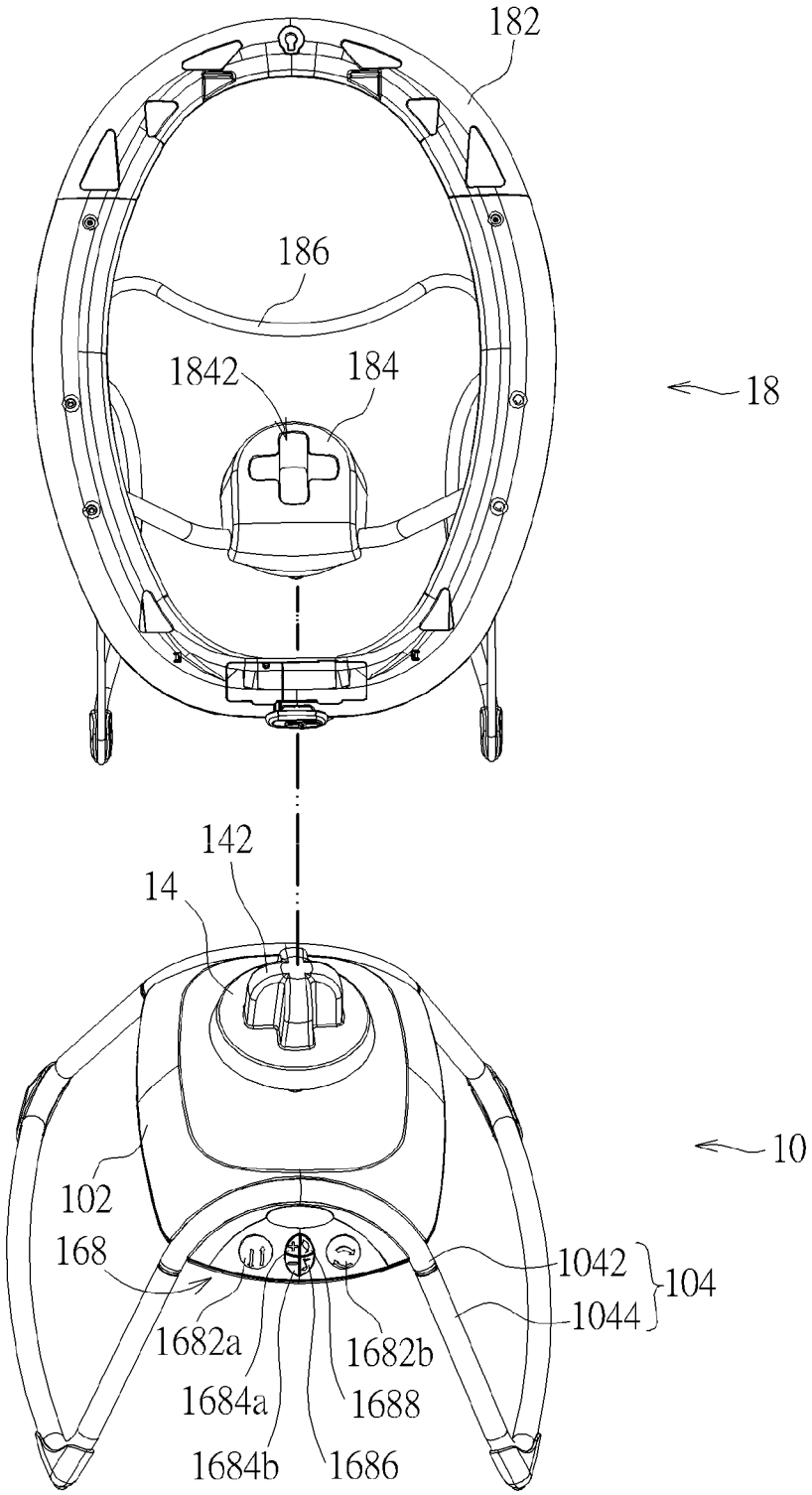
FIG. 2 is a schematic diagram illustrating an assembly of a seat assembly and a seat mount of the child motion apparatus in FIG. 1.

In addition, as shown by FIG. 1 and FIG. 2, the seat assembly 18 includes a bouncing supporting frame 186 connected to the seat frame 182. As shown in FIG. 9, the bouncing supporting frame 186 has two bottom portions 1862 arching toward the seat frame 182, two connection arms 1864 bending and extending from the two bottom portions 1862 respectively and connected to the seat frame 182, and a connection portion 1866 connecting the two bottom portions 1862. In the embodiment, the arched angle of the bottom portion 1862 is about 20 degrees. When the seat assembly 18 is detached from the seat mount 14, the seat assembly 18 can be supported on the ground or a floor through the two bottom portions 1862 of the bouncing supporting frame 186 whereby the seat assembly 18 is able to bounce relative to the ground or the floor. Therein, a room S1 exists between the bent-upward bottom portion 1862 and the ground, which is convenient for the user to hold the two bottom portions 1862 without being clamped, as shown by FIG. 9. The connection arms 1864 can offer a bounce function for the seat frame 182; that is, the seat assembly 18 now can be used as a bouncer. When the seat assembly 18 is attached to the seat mount 14 through the connection support 184, the bouncing supporting frame 186 hangs free, so that the bouncing supporting frame 186 will not interfere with the motion of the seat assembly 18 driven by the motion mechanism 16 and the bounce function is not functional.

Furthermore, in practice, the seat assembly 18 can be replaced with a seat assembly 19 which can be used as a rocker when detached from the seat mount 14, as shown by FIG. 10. The seat assembly 19 is similar to the seat assembly 18 in engaging with the seat mount 14. For other descriptions about the seat assembly 19, please refer to the relevant descriptions about the components of the seat assembly 18 in the same names. In the embodiment, the seat assembly 19 includes a seat frame 192, a connection support 194 fixedly connected to the seat frame 192, and a rocking supporting frame 196 fixedly connected to the connection support 194. The seat assembly 19 is detachably connected to the seat mount 14 through the connection support 194 by engaging an engagement structure 1942 with the first engagement structure 142. The rocking supporting frame 196 has two bottom portions 1962 bending toward the seat frame 192, i.e. the bottom portion 1962 shows a curved structure with an upward opening. In the embodiment, the two bottom portions 1962 are provided by a looped structure. When the seat assembly 19 is detached from the seat mount 14, the seat assembly 19 is supported on a floor through the two bottom portions 1962 of the rocking supporting frame 196 whereby the seat assembly 19 is able to rock relative to the floor. The rocking supporting frame 196 can offer a rocker function for the seat frame 192; that is, the seat assembly 19 now can be used as a rocker. When the seat assembly 19 is attached to the seat mount 14 through the connection support 194, the rocking supporting frame 196 is fixedly connected to the seat mount 14 through the connection support 194, so that the rocking supporting frame 196 will not interfere with the motion of the seat assembly 19 driven by the motion mechanism 16 and the rocker function is not functional.

In the above child motion apparatus 1, the motion mechanism 16 is illustrated by the sliding mechanism 162 and the rotating mechanism 164; however, the invention is not limited thereto. Please refer to FIG. 11 and FIG. 12. A sliding mechanism 362 is used for sliding the platform 122 of the movable carrier 12 relative to the apparatus base 10 along the sliding direction D1; a rotating mechanism 364 is used for rotating the seat mount 14 about the rotation axis 14*a*. Therein, the movable carrier 12 and the seat mount 14 in FIG. 11 and FIG. 12 are slightly different in structure to the movable carrier 12 and the seat mount 14 in the above other figures; however, their operational method are the same, so the movable carrier 12 and the seat mount 14 in FIG. 11 and FIG. 12 still use the same notations for their components for simplification. As shown by FIG. 11 and FIG. 12, the sliding mechanism 362 includes a first link part 3622 and a second link part 3624, which are pivotally connected to the platform 122 and the apparatus base 10 (or the base body 102) respectively and are pivotally connected with each other. When any one of the first link part 3622, the second link part 3624, and the platform 122 moves, the others will be kinematically driven to move accordingly. Therefore, the first link part 3622, the second link part 3624, the platform 122, and the apparatus base 10 show a four-bar linkage.

In the embodiment, a link length (indicated by a bold line in FIG. 11) of the second link part 3624 is larger than a link length (indicated by a bold line in FIG. 11) of the first link part 3622. The first link part 3622 is a gear wheel. The sliding mechanism 362 also includes a first motor 3626 and a gear set 3628. The gear set 3628 is kinematically connected to the first motor 3626 and the gear wheel (or the first link part 3622). Therefore, when the first motor 3626 is powered to drive the gear set 3628, the gear wheel is driven by the gear set 3628 to drive the second link part 3624 to rotate (or sway) so that the platform 122 reciprocates along the sliding direction D1 relative to the apparatus base 10. In the embodiment, the gear set 3628 can be a reduction gear set that may include a plurality spur gears arranged to mesh with each other. The gear set 3628 directly meshes with the output shaft of the first motor 3626 and the first link part 3622. The practical details for the gear set 3628 (and the engagement thereof with the first motor 3626) can be easily practiced by a person skilled in this field, which will not be described in addition.

Please also refer to FIG. 13. In the embodiment, the first link part 3622 (i.e. the gear wheel) is not a simple gear wheel. The gear wheel includes a wheel body 36222 and an intermediate part 36224 which are rotatable about the same rotation axis relative to the platform 122; that is, the wheel body 36222 and the intermediate part 36224 has the same rotation axis (i.e. the axis by which the first link part 3622 is pivotally connected to the platform 122). The wheel body 36222 has outer teeth 36222*a* and inner teeth 36222*b*. The intermediate part 36224 has a paw 36224*a* resiliently engaged with the inner teeth 36222*b*. The gear set 3628 is kinematically connected to the gear wheel through the outer teeth 36222*a* of the wheel body 36222. The second link part 3624 is pivotally connected to the gear wheel through the intermediate part 36224. When a force transferred between the paw 36224*a* and the inner teeth 36222*b* exceeds a threshold, the paw 36224*a* slips relative to the inner teeth 36222*b* (i.e. the paw 36224*a* moves from one tooth to another of the inner teeth 36222*b*), which can protect the first motor 3626 from being overheated when it is hard to slide the platform 122, e.g. in a case that a child sitting on the seat assembly 18 is overweight so that the first motor 3626 is overloaded. In addition, in the embodiment, the intermediate part 36224 has two of the paw 36224*a* in fact, which can enhance the stability and reliability of transferring force between the intermediate part 36224 and the wheel body 36222.

Please refer to FIG. 11 and FIG. 12. The rotating mechanism 364 includes a first link part 3642, a second link part 3644, and a third link part 3646. The first link part 3642 is pivotally connected to the platform 122. The second link part 3644 is pivotally connected to the first link part 3642. The third link part 3646 is pivotally connected to the second link part 3644 and fixedly connected to the seat mount 14. When any one of the first link part 3642, the second link part 3644, and the third link part 3646 moves, the others will be kinematically driven to move accordingly. Therefore, the first link part 3642, the second link part 3644, the third link part 3646, and the platform 122 also show a four-bar linkage.

In the embodiment, a length sum of a link length (indicated by a bold line in FIG. 11) of the third link part 3646 and a distance (indicated by a bold line in FIG. 11) between the rotation axis 14*a* and a position where the first link part 3642 is pivotally connected to the platform 122 is larger than a length sum of a link length (indicated by a bold line in FIG. 11) of the first link part 3642 and a link length (indicated by a bold line in FIG. 11) of the second link part 3644; a length sum of the link length of the second link part 3644 and the link length of the third link part 3646 is larger than a length sum of the link length of the first link part 3642 and the distance. The first link part 3642 is a gear wheel. The rotating mechanism 364 also includes a second motor 3648 and a gear set 3650. The gear set 3650 is kinematically connected to the second motor 3648 and the gear wheel (or the first link part 3642). Therefore, when the second motor 3648 is powered to drive the gear set 3650, the gear wheel is driven by the gear set 3650 to drive the second link part 3644 to drive the third link part 3646 to rotate (or sway) so that the seat mount 14 rotationally reciprocates about the rotation axis 14*a* relative to the platform 122. Similar to the sliding mechanism 362, the gear set 3650 can be a reduction gear set that may include a plurality spur gears arranged to mesh with each other. The gear set 3650 directly meshes with the output shaft of the second motor 3648 and the first link part 3642. The practical details for the gear set 3650 (and the engagement thereof with the second motor 3648) can be easily practiced by a person skilled in this field, which will not be described in addition.

Please also refer to FIG. 14. In the embodiment, the first link part 3642 (i.e. the gear wheel) is not a simple gear wheel. The gear wheel includes a wheel body 36422 and an intermediate part 36424 which are rotatable about the same rotation axis relative to the platform 122; that is, the wheel body 36422 and the intermediate part 36424 has the same rotation axis (i.e. the axis by which the first link part 3642 is pivotally connected to the platform 122). The wheel body 36422 has outer teeth 36422*a* and inner teeth 36422*b*. The intermediate part 36424 has a paw 36424*a* resiliently engaged with the inner teeth 36422*b*. The gear set 3650 is kinematically connected to the gear wheel through the outer teeth 36422*a* of the wheel body 36422. The second link part 3644 is pivotally connected to the gear wheel through the intermediate part 36424. When a force transferred between the paw 36424*a* and the inner teeth 36422*b* exceeds a threshold, the paw 36424*a* slips relative to the inner teeth 36422*b* (i.e. the paw 36424*a* moves from one tooth to another of the inner teeth 36422*b*), which can protect the second motor 3648 from being overheated when it is hard to slide the platform 122, e.g. in a case that a child sitting on the seat assembly 18 is overweight so that the second motor 3648 is overloaded. In addition, in the embodiment, the intermediate part 36424 has two of the paw 36424*a* in fact, which can enhance the stability and reliability of transferring force between the intermediate part 36424 and the wheel body 36422.

In addition, in practice, the gear sets 3628 and 3650 can be practiced by other kinds of reduction gear sets, e.g. by a worm drive. For example, the sliding mechanism 362 can be replaced with a transmission mechanism as shown by FIG. 15. Therein, the worm screw of the worm drive 3628' is directly fixed on the output shaft of the first motor 3626', the worm gear of the worm drive 3628' directly meshes with the gear wheel 3622', and the link part 3624' is pivotally connected to the gear wheel 3622' (or exactly the intermediate part thereof). Therefore, the gear wheel 3622' (or exactly a gear combination) is equivalent to the first link part 3622 (or the assembly of the wheel body 36222 and the intermediate part 36224). The link part 3624' is equivalent to the second link part 3624. The first motor 3626' is equivalent to the first motor 3626. The worm drive 3628' is equivalent to the gear set 3628. Furthermore, the rotating mechanism 364 can be replaced with a similar transmission mechanism like the above shown by FIG. 15. In addition, the sliding mechanism 162 and the rotating mechanism 164 also can be replaced with a transmission mechanism in a similar way to the above.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A child motion apparatus, comprising:

an apparatus base;

a movable carrier, comprising a platform and being movably disposed on the apparatus base along a sliding direction;

a seat mount, rotatably connected to the platform about a rotation axis perpendicular to the sliding direction, the seat mount comprising a first engagement structure of a first non-circular structure profile relative to the rotation axis;

a motion mechanism, comprising:

a sliding mechanism, connecting the platform and the apparatus base for sliding the platform relative to the apparatus base along the sliding direction; and a rotating mechanism, disposed on the platform and connected to the seat mount for rotating the seat mount about the rotation axis; and a seat assembly, comprising a seat frame and a connection support fixedly connected to the seat frame, the connection support comprising a second engagement structure of a second non-circular structure profile, the first non-circular structure profile matching with the second non-circular structure profile, the connection support being detachably connected to the seat mount by engaging the second engagement structure with the first engagement structure in one of at least two orientations of the connection support relative to the seat mount.

2. The child motion apparatus of claim 1, wherein the apparatus base comprises a base body, supporting feet, and expanding legs, the supporting feet are fixed on the base body, the expanding legs are detachably connected to the supporting feet, and the movable carrier, and the motion mechanism are disposed in the base body.

3. The child motion apparatus of claim 2, wherein the expanding leg has a hole, and the supporting feet are inserted into the holes.

4. The child motion apparatus of claim 1, wherein the seat assembly comprises a bouncing supporting frame connected to the seat frame and having two bottom portions arching toward the seat frame, and when the seat assembly is detached from the seat mount, the seat assembly is supported on a floor through the two bottom portions of the bouncing supporting frame whereby the seat assembly is able to bounce relative to the floor.

5. The child motion apparatus of claim 1, wherein the seat assembly comprises a rocking supporting frame connected to the seat frame and having two bottom portions bending toward the seat frame, and when the seat assembly is detached from the seat mount, the seat assembly is supported on a floor through the two bottom portions of the rocking supporting frame whereby the seat assembly is able to rock relative to the floor.

6. The child motion apparatus of claim 1, wherein the sliding mechanism comprises a first link part and a second link part, which are pivotally connected to the platform and the apparatus base respectively and are pivotally connected with each other, and a link length of the second link part is larger than a link length of the first link part.

7. The child motion apparatus of claim 6, wherein the first link part is a gear wheel, the sliding mechanism comprises a motor and a gear set, and the gear set is kinematically connected to the motor and the gear wheel.

8. The child motion apparatus of claim 7, wherein the gear set comprises a worm screw and a worm gear meshing with the worm screw, the worm screw is kinematically connected to the motor, and the worm gear is kinematically connected to the gear wheel through a gear meshing.

9. The child motion apparatus of claim 7, wherein the gear wheel comprises a wheel body and an intermediate part which are rotatable about the same rotation axis relative to the platform, the wheel body has outer teeth and inner teeth, the intermediate part has a paw resiliently engaged with the inner teeth, the gear set is kinematically connected to the gear wheel through the outer teeth of the wheel body, the second link part is pivotally connected to the gear wheel through the intermediate part, and when a force transferred between the paw and the inner teeth exceeds a threshold, the paw slips relative to the inner teeth.

10. The child motion apparatus of claim 1, wherein the rotating mechanism comprises a first link part, a second link part, and a third link part, the first link part is pivotally connected to the platform, the second link part is pivotally connected to the first link part, the third link part is pivotally connected to the second link part and fixedly connected to the seat mount, a length sum of a link length of the third link part and a distance between the rotation axis and a position where the first link part is pivotally connected to the platform is larger than a length sum of a link length of the first link part and a link length of the second link part, and a length sum of the link length of the second link part and the link length of the third link part is larger than a length sum of the link length of the first link part and the distance.

11. The child motion apparatus of claim 10, wherein the first link part is a gear wheel, the rotating mechanism comprises a motor and a gear set, and the gear set is kinematically connected to the motor and the gear wheel.

12. The child motion apparatus of claim 11, wherein the gear set comprises a worm screw and a worm gear meshing with the worm screw, the worm screw is kinematically connected to the motor, and the worm gear is kinematically connected to the gear wheel through a gear meshing.

13. The child motion apparatus of claim 11, wherein the gear wheel comprises a wheel body and an intermediate part which are rotatable about the same rotation axis relative to the platform, the wheel body has outer teeth and inner teeth, the intermediate part has a paw resiliently engaged with the inner teeth, the gear set is kinematically connected to the gear wheel through the outer teeth of the wheel body, the second link part is pivotally connected to the gear wheel through the intermediate part, and when a force transferred between the paw and the inner teeth exceeds a threshold, the paw slips relative to the inner teeth.

14. The child motion apparatus of claim 1, wherein the motion mechanism comprises a controller and a control panel electrically connected to the controller, the sliding mechanism comprises a first motor electrically connected to the controller, the rotating mechanism comprises a second motor electrically connected to the controller, and when the controller receives an input operation by a user through the control panel, the controller, according to the input operation, controls the first motor of the sliding mechanism to drive the platform to slide relative to the apparatus base along the sliding direction and the second motor of the rotating mechanism to drive the seat mount to rotate about the rotation axis.

15. The child motion apparatus of claim 14, wherein the control panel comprises two motion knobs, which are electrically connected to the controller and through which the controller receives the input operation.

16. The child motion apparatus of claim 14, wherein the two motion knobs respectively and independently control the rotating speed of the first motor of the sliding mechanism and the rotating speed of the second motor of the rotating mechanism.

17. The child motion apparatus of claim 14, further comprising a speaker, electrically connected to the controller, wherein the control panel comprises two volume buttons, a music button, and an imitative noise button, which are electrically connected to the controller and through which the controller receives the input operation, the controller controls the speaker to play music when the music button is pressed, the controller controls the speaker to play imitative noise when the imitative noise button is pressed, and the controller adjusts an output volume of the speaker when one of the two volume buttons is pressed.

18. The child motion apparatus of claim 1, wherein the rotation axis passes through the seat mount and the connection support.

19. A child motion apparatus, comprising:

an apparatus base;

a movable carrier, comprising a platform and being movably disposed on the apparatus base along a sliding direction;

a seat mount;

a motion mechanism, comprising:

a sliding mechanism, connecting the platform and the apparatus base for sliding the platform relative to the apparatus base along the sliding direction; and a seat assembly, comprising a seat frame and a connection support fixedly connected to the seat frame, the connection support being detachably connected to the seat mount;

wherein the seat mount comprises a first engagement structure of a first non-circular structure profile, the connection support comprises a second engagement structure of a second non-circular structure profile, the first non-circular structure profile matches with the second non-circular structure profile, and the connection support is detachably connected to the seat mount by engaging the second engagement structure with the first engagement structure in one of at least two orientations of the connection support relative to the seat mount.

20. A child motion apparatus, comprising:

an apparatus base;

a carrier, comprising a platform;

a seat mount, rotatably connected to the platform about a rotation axis;

a motion mechanism, comprising:

a rotating mechanism, disposed on the platform and connected to the seat mount for rotating the seat mount about the rotation axis; and a seat assembly, comprising a seat frame and a connection support fixedly connected to the seat frame, the connection support being detachably connected to the seat mount;

wherein the seat mount comprises a first engagement structure of a first non-circular structure profile, the connection support comprises a second engagement structure of a second non-circular structure profile, the first non-circular structure profile matches with the second non-circular structure profile, and the connection support is detachably connected to the seat mount by engaging the second engagement structure with the first engagement structure in one of at least two orientations of the connection support relative to the seat mount.

21. The child motion apparatus of claim 20, wherein the rotation axis passes through the seat mount and the connection support.

* * * * *